US007404453B2

(12) United States Patent
Boys

(10) Patent No.: US 7,404,453 B2
(45) Date of Patent: Jul. 29, 2008

(54) METHOD AND APPARATUS FOR FORMING SQUARE HOLES FOR POSTS

(76) Inventor: Donald R. Boys, 2720 Tierra Way, Aromas, CA (US) 95004

( * ) Notice: Subject to any disclaimer, the term of this patent is extended or adjusted under 35 U.S.C. 154(b) by 108 days.

(21) Appl. No.: 11/370,452

(22) Filed: Mar. 7, 2006

(65) Prior Publication Data

US 2007/0209840 A1 Sep. 13, 2007

(51) Int. Cl.
*E21B 3/06* (2006.01)

(52) U.S. Cl. ..... 175/19; 175/162

(58) Field of Classification Search ..... 175/19, 175/57, 122, 162

See application file for complete search history.

(56) References Cited

U.S. PATENT DOCUMENTS 4,770,256 A * 9/1988 Lipsker et al. ..... 175/57
7,080,697 B2 * 7/2006 Mocivnik ..... 175/22

FOREIGN PATENT DOCUMENTS

JP 2000-248867 A * 3/1999

* cited by examiner

*Primary Examiner*—William P Neuder
(74) *Attorney, Agent, or Firm*—Central Coast Patent Agency, Inc.

(57) ABSTRACT

A tool for expanding a hole having a vertical axis in the earth has at least one set of two opposed compactor units constrained to separate and retract in a direction at a right angle to the axis of the hole, and a drive mechanism coupled to the set of compactor units providing force to separate the compactor units, urging the units against a wall or walls of the hole, compacting the earth and enlarging the hole.

6 Claims, 8 Drawing Sheets

METHOD AND APPARATUS FOR FORMING SQUARE HOLES FOR POSTS

BACKGROUND OF THE INVENTION

1. Field of the Invention

The present invention is in the area of equipment and methods for creating post holes, and pertains more particularly to making square holes of a size for square fence posts.

2. Discussion of the State of the Art

It is well known that there exist at the time of this application a number of alternative tools and methods for digging post holes. A well known tool is the two-handed post-hole spade that has long handles and opposed spades connected at a pivot, such that the spades may be opened by pulling the handle apart and closed by closing the handles. A worker uses both hands to drive the opposed spades into the earth, closes the spades to collect loose earth, and raises the tool out of the developing hole to set the loose earth aside; then repeats the process until the desired depth is attained. It is also well-known that this tool and method is clumsy, tiring, and generally results in a rather large round hole.

Other than hand tools there exists a number of power tools, such as drills and augers of various sorts for making post holes. These are invariably rotary devices that produce round holes, but typically the holes produced by these power tools are more uniform and close to desired size than those produced by hand tools.

Although there are round posts that certainly may be used in round post holes, many people prefer square posts, and for the purpose of this specification four-inch square posts will be considered.

To set a four-by-four post in a post hole, one must produce a round post hole of a diameter great enough to insert the post. For a four-by-four post the diameter needed is the length of the corner-to-corner diagonal of the post, which is 5.67 inches to the nearest one-hundredth of a inch. There needs to be some clearance, so the smallest workable hole diameter is about six inches.

Once one has made a six-inch diameter hole to a desired depth, the post is placed in the hole to the bottom of the hole, leaving relatively large spaces all around the post. Now it is necessary to add loose earth back into the spaces, which are typically rodded to compact the loose soil to better hold the post. This is a difficult process.

What is clearly needed is an apparatus and method for forming a square post hole of very close to the size of the post, with sides that are formed closely compacted in the process, so the post can be driven into the square hole completing the process.

SUMMARY OF THE INVENTION

In one embodiment of the invention a tool for expanding a hole having a vertical axis in the earth is provided, comprising at least one set of two opposed compactor units constrained to separate and retract in a direction at a right angle to the axis of the hole, and a drive mechanism coupled to the set of compactor units providing force to separate the compactor units, urging the units against a wall or walls of the hole, compacting the earth and enlarging the hole.

Also in an embodiment of the invention the compactor units comprise lengths of angle iron that when fully retracted form together a substantially square shape, and the direction of separation and retraction is along the diagonal through the apex corners of the two angle irons. Also in an embodiment the drive mechanism comprises a linear actuator constrained to travel vertically, the actuator and individual compactor units joined by links pivoted both at the actuator and the individual compactor units. The drive mechanism may also have a fluid cylinder coupled to the linear actuator, the fluid cylinder driving the linear actuator vertically to the limits of the cylinder action. In still other embodiments there may be two or more sets of opposed compactor units.

In another aspect of the invention a method for producing a hole in the earth for setting a post having a cross section of a particular shape and area is provided, comprising the steps of (a) making a hole of a cross section less in area than the area of the cross section of the post to be set; (b) placing in the hole an expansion tool; and (c) activating the expansion tool to expand and shape the cross section of the hole.

In one embodiment of the method the expansion tool comprises at least one set of two opposed compactor units constrained to separate and retract in a direction at a right angle to the axis of the hole, and a drive mechanism coupled to the set of compactor units providing force to separate the compactor units, urging the units against a wall or walls of the hole, compacting the earth and enlarging the hole.

Also in one embodiment of the method in step (a) the original cross section of the hole is round, and in step (c) the hole is expanded to a square cross section shape of an area greater than the original cross section area. In some cases in step (c) two or more operations are employed with the expansion tool rotated on the axis of the hole between operations, and in some of these embodiments the final shape of the hole is substantially square.

BRIEF DESCRIPTION OF THE DRAWING FIGURES

Figure 1:
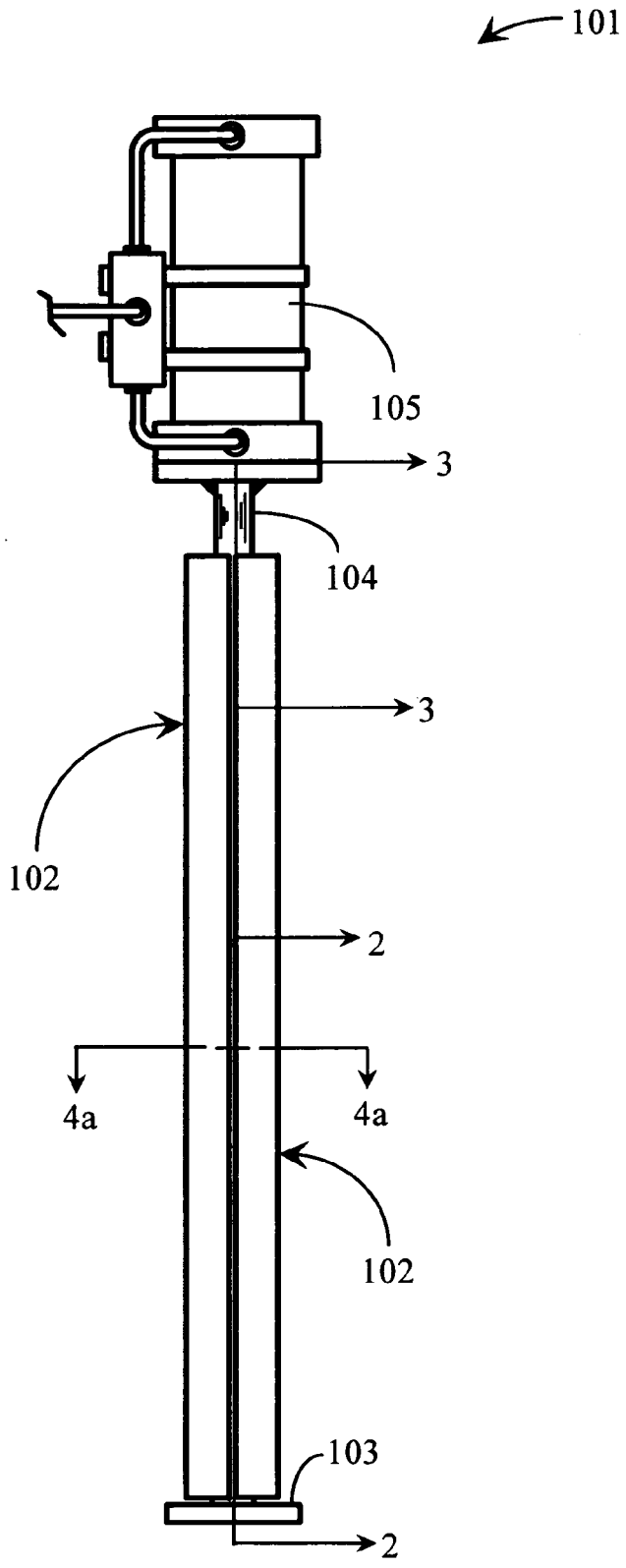
FIG. 1 is a perspective view of an expander tool according to an embodiment of the present invention for making a round hole into a larger square hole.
Figure 2:
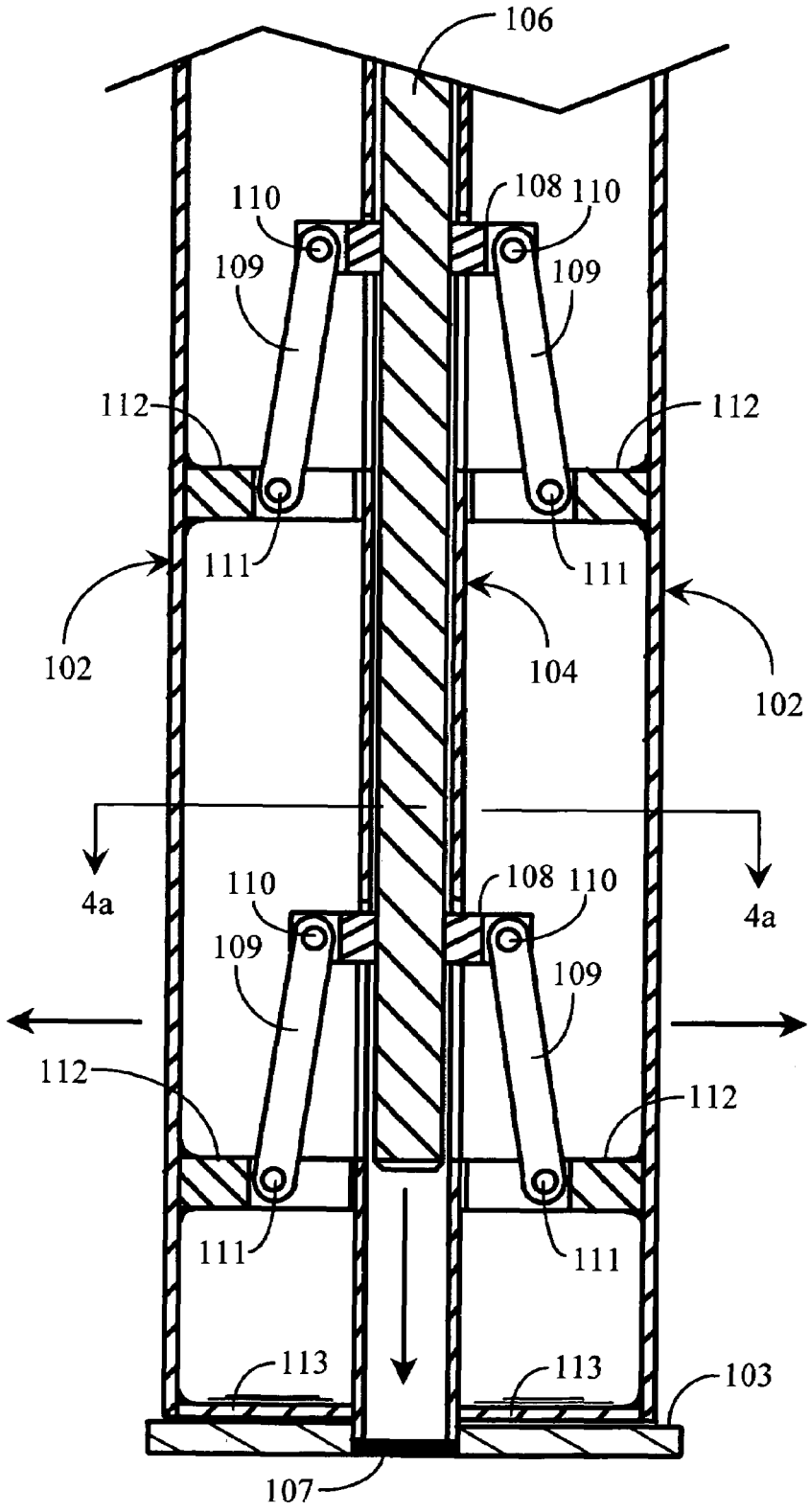
FIG. 2 is a vertical elevation section view of a portion of the height from the bottom of the expander tool of FIG. 1.
Figure 4B:
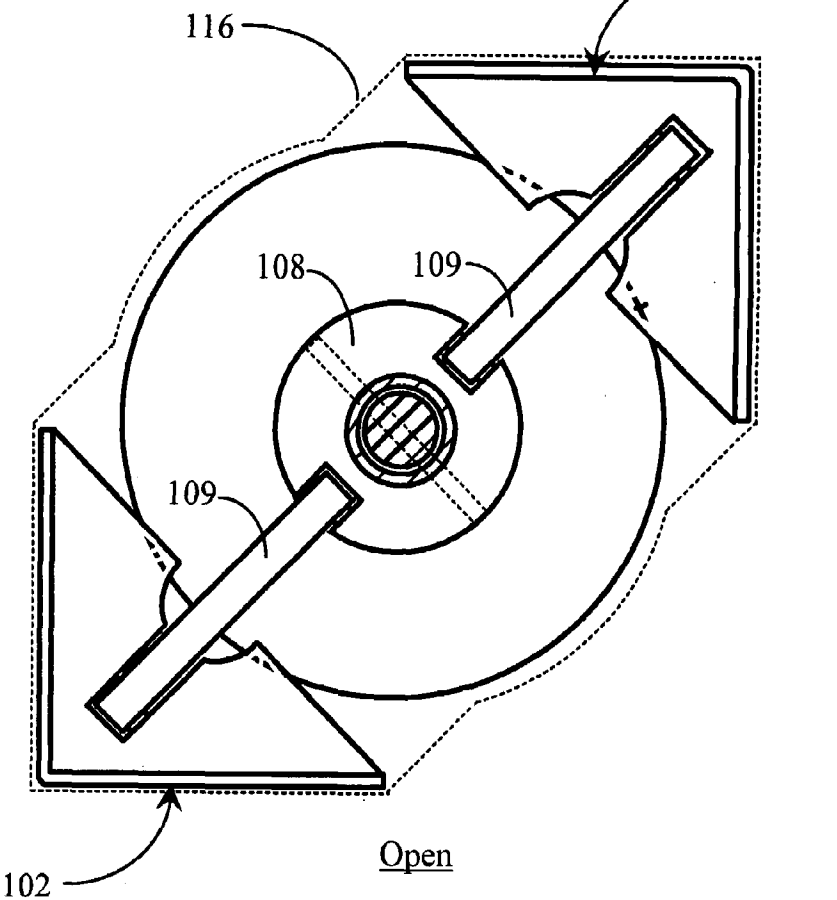
Figure 4A:
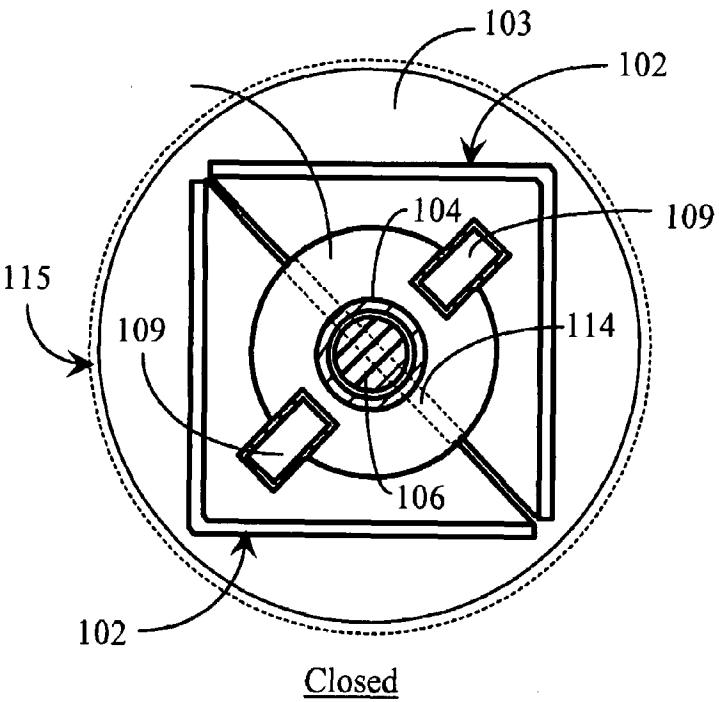

FIG. 4*a* is a cross-section view taken along line 4*a*-4*a* of FIGS. 1 and 2.

FIG. 4*b* is a cross-section along the same section line as FIG. 4*a*, showing the expander expanded to full range.

Figure 5B:
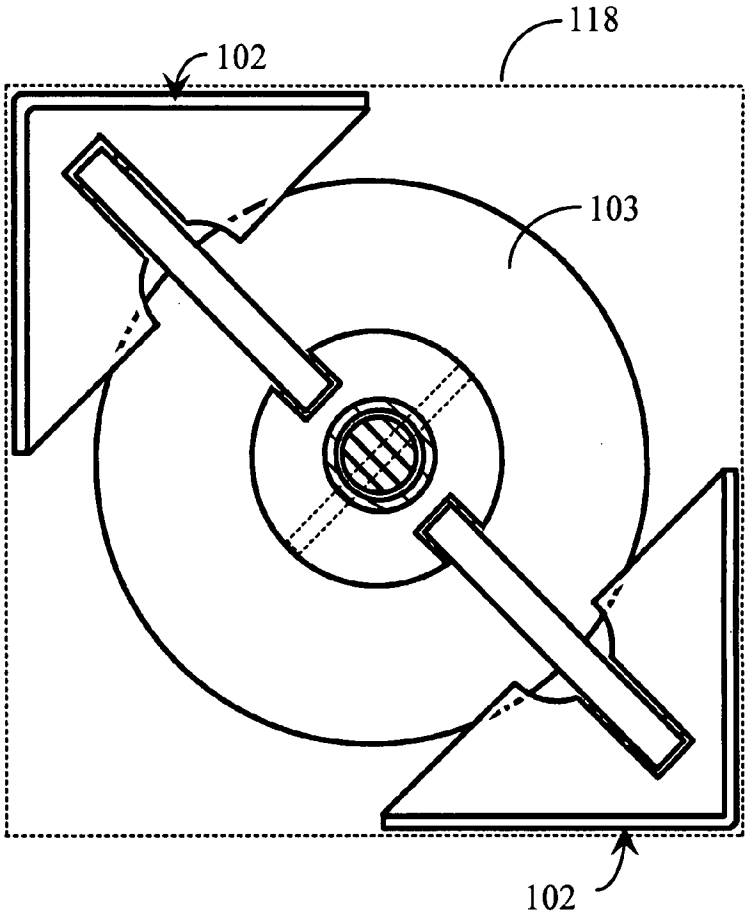
Figure 5A:
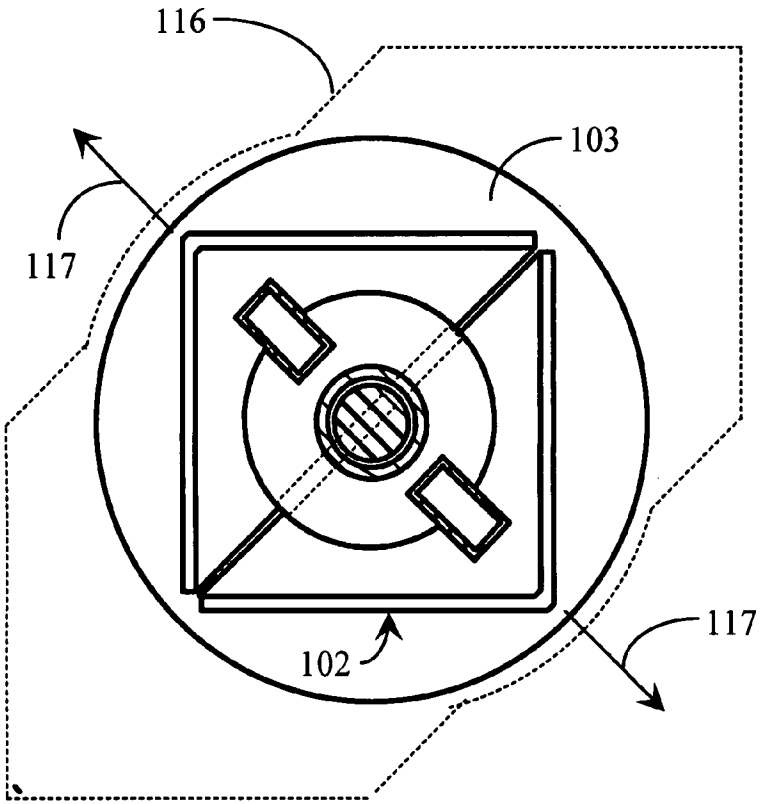

FIG. 5*a* indicates relocation of the expander for a second operation according to an embodiment of the present invention.

FIG. 5*b* shows the result after a second extension of the expander from the position shown in FIG. 4*a*.

Figure 6:
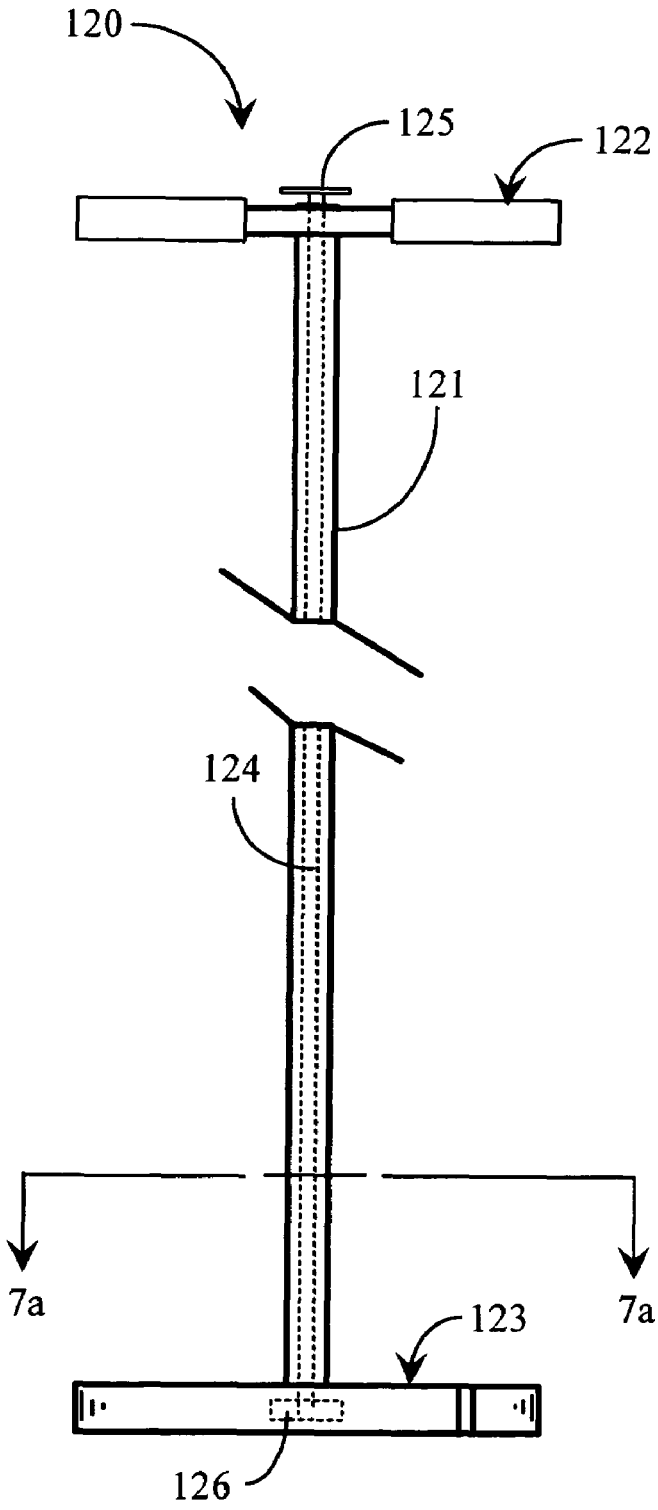

FIG. 6 is an elevation view of a manual tool 120 for creating an undercut at the bottom of the square hole developed using the expander described above.

Figure 7A:
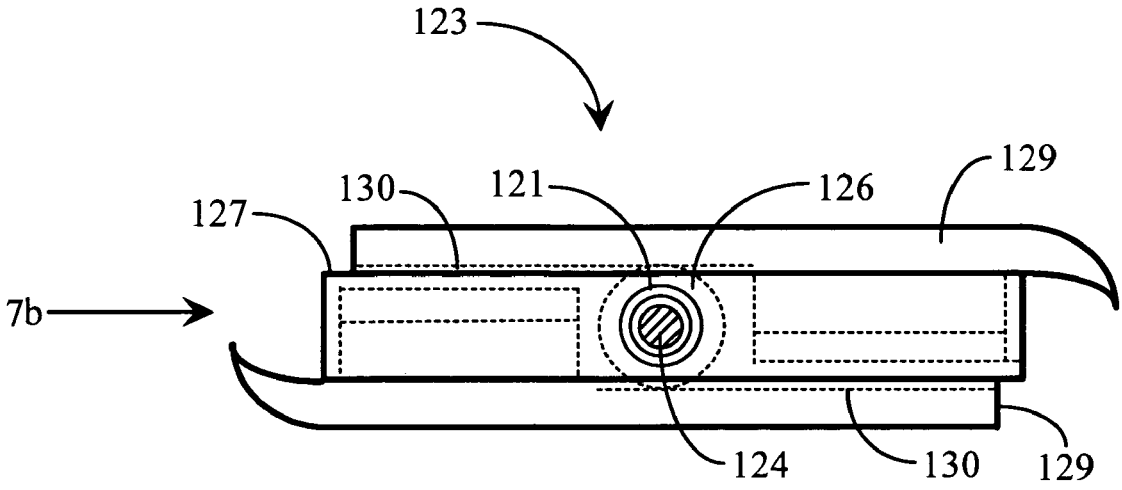

FIG. 7*a* is a section taken along line 7*a*-7*a* of FIG. 6 showing a plan view of an adjustable cutting head for the tool of FIG. 6.

Figure 7B:
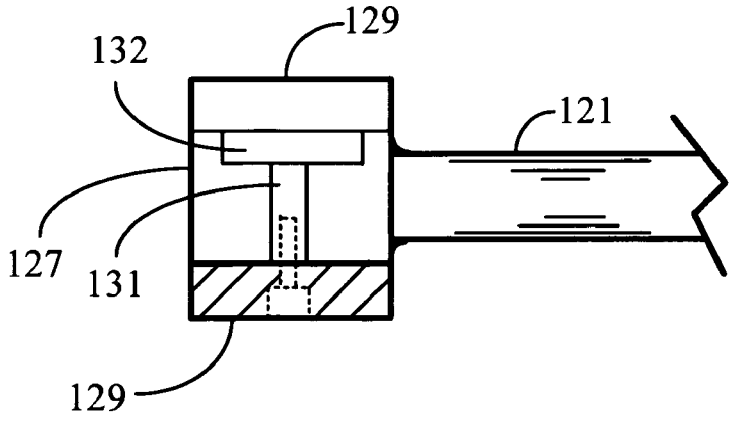

FIG. 7*b* is a view of one end of the cutting head of FIG. 7*a*.

Figure 8:
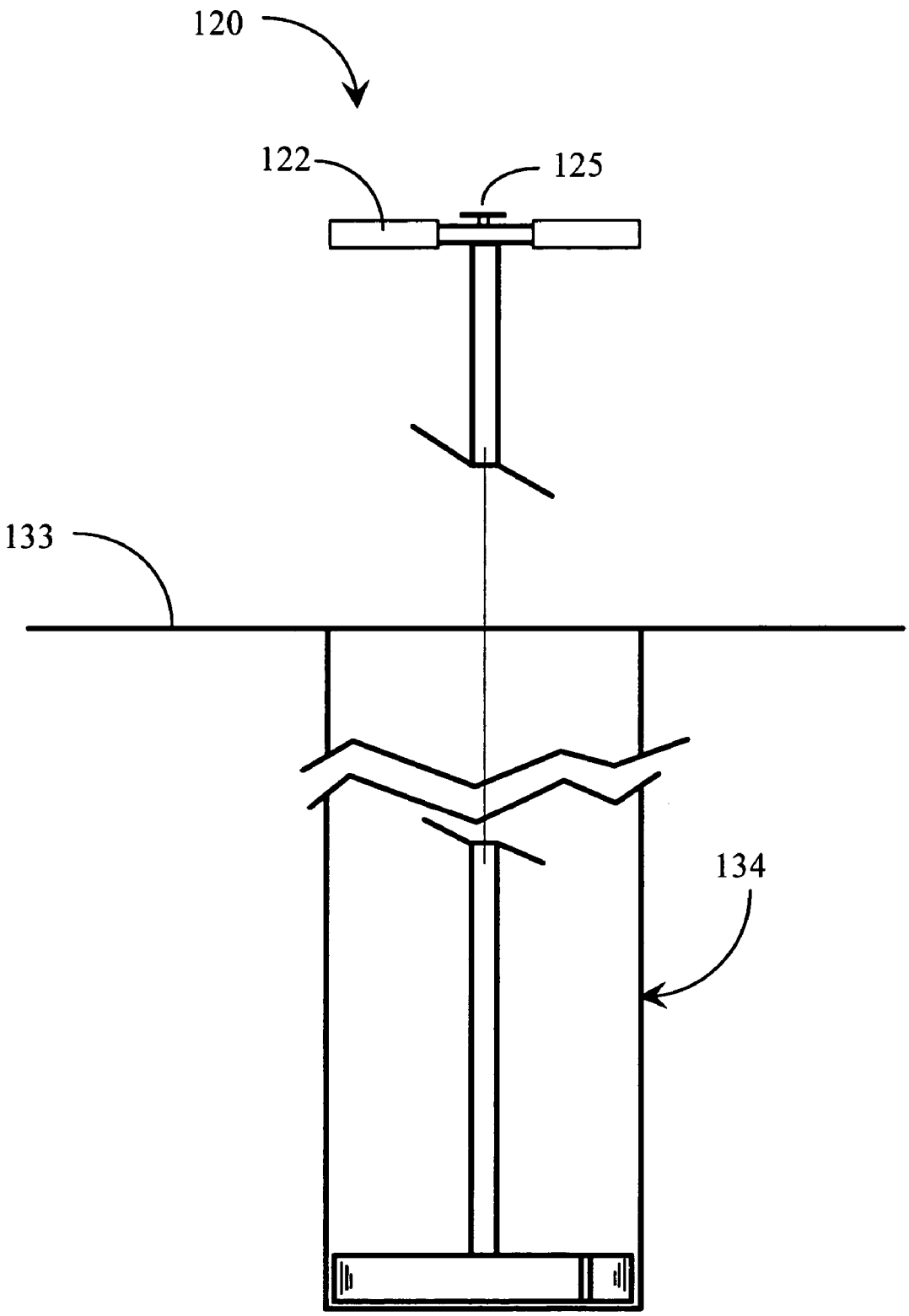

FIG. 8 illustrates a square hole formed by an expander according to an embodiment of the present invention, with a manual undercut tool according to an embodiment of the invention.

DETAILED DESCRIPTION OF THE INVENTION

FIG. 1 is a perspective view of an expander tool 101 according to an embodiment of the present invention for expanding a round hole into a larger square hole. Expander tool 101 comprises in this embodiment two angle iron assemblies 102 having two-inch legs engaged in a mechanism described in detail below. The mechanism, driven in this example by a pneumatic cylinder 105 through a tubing assembly 104 mounted to a round base plate 103, causes angle irons 102 to separate when the cylinder is activated with sufficient force to push a small diameter hole into a larger square hole while also compacting the soil around the resulting square post hole.

FIG. 2 is a vertical elevation section view of a portion of the height from the bottom of expander tool 101 of FIG. 1 taken along the section line 2-2. An activator rod 106 engaged to and driven vertically by cylinder 105 operates within tubing assembly 104, which is welded into base plate 103 along region 107 in this embodiment. Pusher blocks 108 are affixed to rod 106 through slots in tubing assembly 104, the slots being of sufficient length to accommodate the full necessary stroke of rod 106 to fully open and close the two angle iron assemblies 102. Two sets of slots and pusher blocks are shown, but there may be several more, depending on the overall height of the expander tool, which determines the depth of a hole that may be expanded.

Pusher blocks 108 are pivotally connected to pusher links 109 with pivot pins 110, and at the opposite ends the pusher links are pivotally connected by pivot pins 111 to brackets 112 which are welded in this embodiment at strategic locations along each angle iron assembly 102. The angle iron assemblies are closed at the lower end by welded plates 113, such that when cylinder 105 is activated and drives rod 106 downward, the angle iron assemblies are constrained by these plates against base plate 103 to travel outward horizontally. A spring mechanism (not shown) retracts the angle iron assemblies horizontally when the cylinder is retracted.

Figure 3:
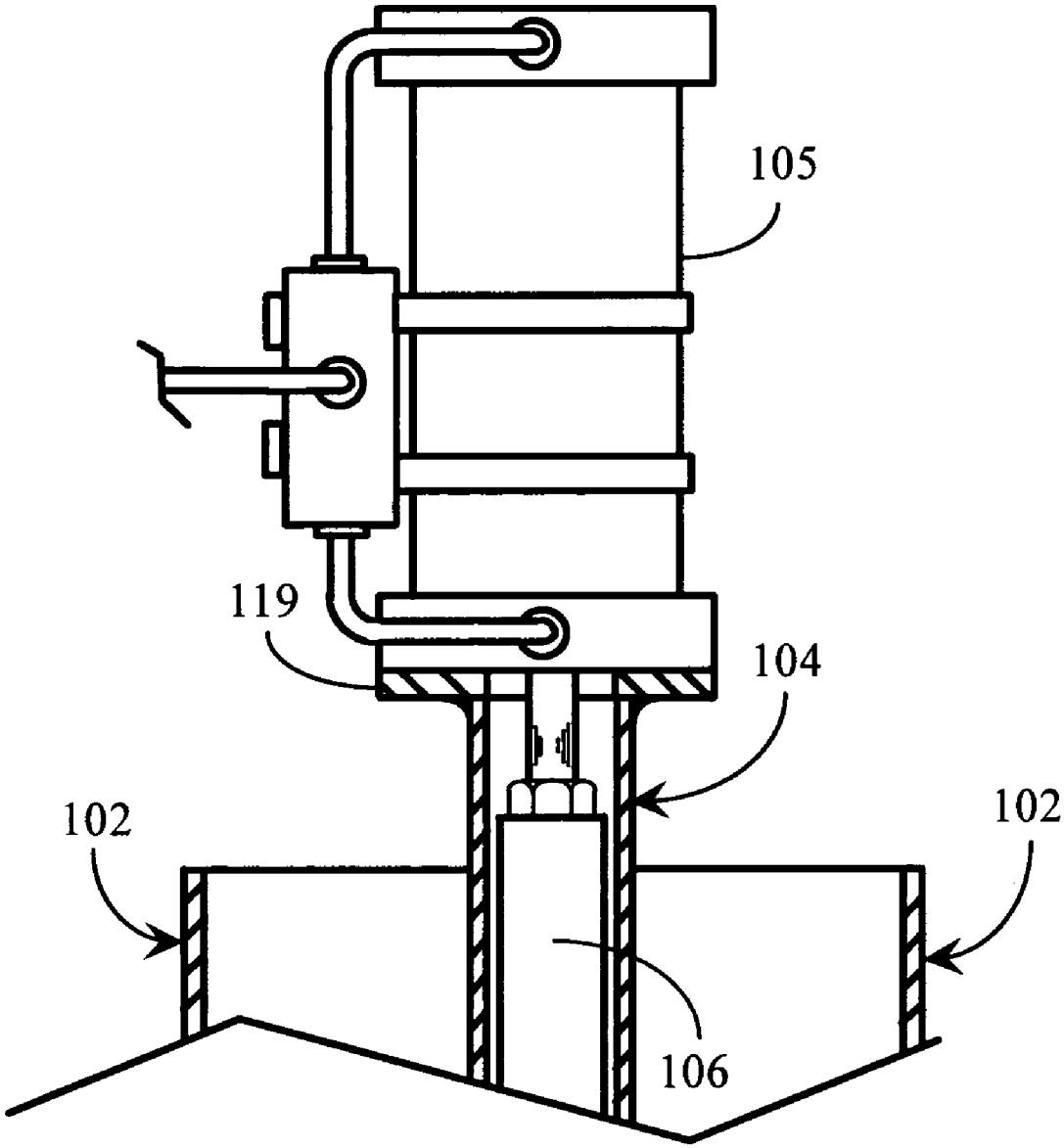
FIG. 3 is a partial section taken along section line 3-3 of FIG. 1 showing attachment of a drive cylinder to the tubing assembly.

FIG. 3 is a partial section taken along section line 3-3 of FIG. 1 showing attachment of cylinder 105 to tubing assembly 104. In the tubing assembly, the main vertical tube is welded in this embodiment to base pate 103, as described above, and as shown in FIG. 3 is welded to an upper plate 119, which is machined to match the mounting interface for the cylinder. The cylinder is mounted to plate 119 with conventional fasteners (not shown). The active shaft of the cylinder in this embodiment has a male thread, is threaded into a female thread in rod 106, and is secured with a standard locking nut.

FIG. 4*a* is a cross-section view taken along line 4*a*-4*a* of FIGS. 1 and 2, and shows the mechanism of the expander in closed position with rod 106 retracted and the angle iron assemblies drawn together presenting the smallest cross-sectional area. Dotted circle 115 indicates diameter of a hole that has to be produced to insert the expander mechanism of the invention. The diameter of this hole is about 3.25 inches, as opposed to a hole of nearly six inches diameter required for setting a 4×4 fence post in the conventional way. Since the volume of earth to be removed to make a hole in the ground is directly related to the area of the hole, for the conventional method more than three times the volume of earth has to be removed.

FIG. 4*b* is along the same section line as FIG. 4*a*, but shows the expander expanded to full range by driving rod 106 downward with cylinder 105. The length of pusher links 109 is made to cause the diagonal distance from corner-to-corner in this position to be just a bit greater than the diagonal measurement of a 4×4 post section. Dotted boundary 116 illustrates the extent of the expanded hole in the earth at this point. It is to be noted (see also FIG. 2) that in the first portion of a downstroke the mechanism produces the least thrust in the direction of the movement of the angle iron assemblies that move and compact the earth, but in this portion the resistance of the earth is also least. In the last portion of the downstroke, when more thrust will be needed, the mechanism produces a great mechanical advantage, and the thrust is maximized.

After the action shown in FIG. 4*b*, producing the shape for the developing hole shown by dotted line 116, the expander is retracted and rotated ninety degrees as shown in FIG. 5*a*. Now activating the expander again will cause the angle iron assemblies to travel in the direction of arrows 117.

FIG. 5*b* shows the result after the second extension of the expander from the position of FIG. 4*a*. Now the developed hole is as shown by dotted line 118, which is square, of a size to accommodate a 4×4 post, and the sides of the hole are very solidly compacted. No fill or rodding is necessary.

A method then, using the apparatus in the embodiment of the invention shown, is to create a hole in the earth of diameter about 3.25 inches, insert the expander, extend and retract the expander, rotate the expander ninety degrees, and then extend and retract the expander again, creating a compacted square hole in the earth of a size to accommodate a 4×4 fence post.

FIG. 6 is an elevation view of a manual tool 120 for creating an undercut at the bottom of the square hole developed using the expander described above. Tool 120 has a vertical hollow tubing 121 that can be rotated by a t-bar 122 mounted at the upper end. The tubing is shown in broken view because the height may be much greater than shown in the view. The t-bar in this example has added hand grips. An adjustable cutter head 123 is mounted at the bottom end, and is adjustable by rotation of a gear 126 by a shaft 124 passing within tubing 121. Shaft 124 has a handle 125 at the upper end for easy adjustment.

FIG. 7*a* is a section view taken along line 7*a*-7*a* of FIG. 6, providing a plan view of cutting head 123. Head 123 comprises main body portion 127 and two adjustable cutting units 129, one on each side of the body. The extended portion of each adjustable cutting unit has a curved scraping edge directed for clockwise rotation. Further each cutting unit has a linear gear face 130 that engages a gear 126 driven by shaft 124. By rotating shaft 124 clockwise (in this view) the cutting units may be extended equally.

FIG. 7*b* is a view of one end of the cutting head in the direction of arrow 7*b* of FIG. 7*a*, which indicates how each cutting unit is restrained and guided. A portion of body 127 is machined to provide channels for panels 131 and 132 which are fastened together and to cutting unit 129 to guide the cutting unit relative to the body. In this view the curved end of the cutting unit has been cut off to be able to see the guide arrangement in full view.

FIG. 8 illustrates a square hole 134 that has been formed by an expander according to an embodiment of the present invention. Manual tool 120 is shown extended to the bottom of hole 134 with the cutting units fully retracted, so the overall width of the cutting head is a bit less than four inches, so it may be introduced into hole 134 without interference. Once in position the operator turns handle 125 (which could also be a knob) clockwise to extend the cutting heads, and also turns the manual tool clockwise using handle 122. The cutting heads scrape earth at the bottom of the hole providing an undercut, the diameter of which is made greater by further turning handle 125, and turning the tool with handle 122.

When the cutting units are fully extended a significant undercut is accomplished, and a quantity of loose earth is left in the bottom of the hole. The cutting units are then retracted and the tool removed. The loose earth may be easily removed by a vacuum hose extended into the bottom of the hole from a shop vacuum apparatus.

Now the user may add concrete or other material into the hole which will flow into the undercut. The material may be, for example, an epoxy thermosetting material. After adding the concrete or plastic the post needs to be set before the added material hardens.

A post set without the undercut will be very secure, because the sides of the square hole are compacted very efficiently in the process of forming the hole. A post set with the undercut and a setting material will be even more secure, and very difficult to remove.

It will be apparent to the skilled artisan that many alterations might be made in the embodiments of the invention described above without departing from the spirit and scope of the invention. For example, the devices described might be sized to produce square holes of much different dimension than 4×4 inches. The devices described in embodiments of the invention might also be used to produce holes in the earth with much different cross-sections than square, including rectangular, polygonal, and even round. To produce a hole for a round post one might drill or auger a hole of considerably smaller diameter than the round post, and use an expander according to an embodiment of this invention, but with "pushers" with the form of circular arcs instead of the angle irons described to urge the earth in the walls of the smaller holes into a larger round hole with the walls greatly compacted. The method of undercutting and filling may be used with a hole of any shape as well.

Further to the above there may be many alterations in the materials used, and in the design to produce the desired effects. There are similarly many other alterations within the spirit and scope of the invention, so the invention is entitled to the scope of the claims that follow:

What is claimed is:

1. A tool for expanding a hole having a vertical axis in the earth, comprising:

at least one set of two opposed compactor units, each unit comprising a length of angle iron, the opposed compactor units constrained to separate and refract in a direction at a right angle to the axis of the hole and along a diagonal through the apex corners of the angle irons; and a drive mechanism coupled to the set of compactor units providing force to separate the compactor units, urging the units against a wall or walls of the hole, compacting the earth and enlarging the hole, wherein the compactor units when fully retracted present a substantially square shape in a plane orthogonal to the vertical axis.

2. The tool of claim 1 comprising two or more sets of opposed compactor units.

3. A tool for expanding a hole having a vertical axis in the earth, comprising:

at least one set of two opposed compactor units constrained to separate and retract in a direction at a right angle to the axis of the hole; and a drive mechanism comprising a linear actuator constrained to travel vertically coupled to the set of compactor units by links pivoted both at the actuator and the compactor units, providing force to separate the compactor units, urging the units against a wall or walls of the hole, compacting the earth and enlarging the hole.

4. The tool of claim 3 wherein the drive mechanism comprises a fluid cylinder coupled to the linear actuator, the fluid cylinder driving the linear actuator vertically to the limits of the cylinder action.

5. A method for producing a hole in the earth for setting a post having a cross section of a particular shape and area, comprising the steps of:

(a) making a round hole of a cross section less in area than the area of the cross section of the post to be set;

(b) placing in the hole an expansion tool having two or more opposed compactor units with square corners; and (c) activating the expansion tool two or more times, with rotation around the vertical axis between expansions, to expand and shape the cross section of the hole to a square cross section shape of an area greater than the original cross section area.

6. A tool for expanding a hole having a vertical axis in the earth, comprising:

four lengths of angle iron arranged in parallel as compactor units constrained to separate and contract in directions at a right angle to the axis of the hole and along diagonals through the apex corners of the angle irons; and a drive mechanism comprising a liner actuator constrained to travel vertically coupled to the compactor units by links pivoted both at the compactor units and at the linear actuator, providing force to separate the compactor units, urging the units against a wall or walls of the hole, compacting the earth and enlarging the hole into a square shape in cross section.

* * * * *

UNITED STATES PATENT AND TRADEMARK OFFICE

CERTIFICATE OF CORRECTION

PATENT NO. : 7,404,453 B2
APPLICATION NO. : 11/370452
DATED : July 29, 2008
INVENTOR(S) : Donald R. Boys It is certified that error appears in the above-identified patent and that said Letters Patent is hereby corrected as shown below:

Column 5, line 40 Claim 1 should read: tor units constrained to separate and retract in a direction Signed and Sealed this Twenty-first Day of April, 2009

JOHN DOLL
*Acting Director of the United States Patent and Trademark Office*